US007878272B2

(12) United States Patent
Eppink

(10) Patent No.: US 7,878,272 B2
(45) Date of Patent: Feb. 1, 2011

(54) FORCED BALANCED SYSTEM

(75) Inventor: Jay Milton Eppink, Spring, TX (US)

(73) Assignee: Smith International, Inc., Houston, TX (US)

( * ) Notice: Subject to any disclaimer, the term of this patent is extended or adjusted under 35 U.S.C. 154(b) by 346 days.

(21) Appl. No.: 12/074,444

(22) Filed: Mar. 4, 2008

(65) Prior Publication Data

US 2009/0223717 A1 Sep. 10, 2009

(51) Int. Cl.
*E21B 7/00* (2006.01)

(52) U.S. Cl. ..... 175/325.1; 175/73

(58) Field of Classification Search ..... 175/73, 175/74, 76, 61, 325.1
See application file for complete search history.

(56) References Cited

U.S. PATENT DOCUMENTS

| | | | | |
|---|---|---|---|---|
| 3,080,924 | A | | 3/1963 | Baker et al. |
| 3,180,436 | A | | 4/1965 | Kellner et al. |
| 3,298,449 | A | | 1/1967 | Bachman et al. |
| 3,595,326 | A | | 7/1971 | Claycomb |
| 3,974,886 | A | | 8/1976 | Blake, Jr. |
| 4,270,619 | A | | 6/1981 | Base |
| 4,284,156 | A | | 8/1981 | Carstensen et al. |
| 4,471,843 | A | * | 9/1984 | Jones et al. ..... 175/73 |
| 4,472,843 | A | | 9/1984 | Jones, Jr. et al. |
| 4,572,305 | A | | 2/1986 | Swietlik |
| 4,635,736 | A | | 1/1987 | Shirley |
| 4,842,083 | A | | 6/1989 | Raney |
| 4,848,488 | A | | 7/1989 | Cendre et al. |
| 4,848,490 | A | | 7/1989 | Anderson |
| 4,947,944 | A | | 8/1990 | Coltman et al. |
| 5,181,576 | A | | 1/1993 | Askew et al. |
| 5,224,558 | A | | 7/1993 | Lee |
| 5,265,684 | A | | 11/1993 | Rosenhauch |
| 5,293,945 | A | | 3/1994 | Rosenhauch et al. |
| 5,318,138 | A | * | 6/1994 | Dewey et al. ..... 175/74 |
| 5,511,627 | A | | 4/1996 | Anderson |
| 5,547,031 | A | | 8/1996 | Warren et al. |
| 5,603,386 | A | | 2/1997 | Webster |
| 6,227,312 | B1 | | 5/2001 | Eppink et al. |
| 6,257,356 | B1 | | 7/2001 | Wassell |
| 6,290,003 | B1 | | 9/2001 | Russell |
| 6,328,119 | B1 | | 12/2001 | Gillis et al. |
| 6,494,272 | B1 | | 12/2002 | Eppink et al. |
| 6,609,579 | B2 | | 8/2003 | Krueger et al. |
| 6,732,817 | B2 | | 5/2004 | Dewey et al. |
| 6,948,572 | B2 | | 9/2005 | Hay et al. |
| 6,997,258 | B2 | * | 2/2006 | Homan et al. ..... 166/254.2 |
| 2001/0045300 | A1 | | 11/2001 | Fincher et al. |
| 2002/0011358 | A1 | | 1/2002 | Wassell |
| 2004/0026128 | A1 | | 2/2004 | Krueger et al. |

* cited by examiner

*Primary Examiner*—Daniel P Stephenson

(57) ABSTRACT

A downhole tool including a purely mechanical stabilizer is disclosed. The stabilizer includes a plurality of fixed blades, each of which includes at least one automatically extendable and retractable piston. In use, a balance of forces determines the radial position of each piston; a hydraulic force urging the piston outward, a spring force urging the piston inward, and external forces acting on the tool (e.g., the force of the borehole wall urging the pistons inward). The stabilizer is further configured such that a balance of forces between the pistons causes the tool to be advantageously automatically and continuously centered during rotation of the tool in the borehole. As such, the invention is suitable for use in boreholes that rapidly change size and shape.

23 Claims, 13 Drawing Sheets

FORCED BALANCED SYSTEM

RELATED APPLICATIONS

None.

FIELD OF THE INVENTION

The present invention relates generally to a downhole stabilizer, for example, including a near-bit stabilizer. More particularly, embodiments of this invention relate to a purely mechanical stabilizer including a plurality of force-balanced pistons disposed to continually center the stabilizer in a borehole during rotation therein.

BACKGROUND OF THE INVENTION

Near-bit stabilizers are well known in downhole drilling applications and are commonly utilized in conjunction with rotary steerable systems in directional drilling applications. Commonly utilized near-bit stabilizers are typically slightly under gauge and not automatically adjustable. As a result, the stabilizer is offset from the center of the borehole by half the difference between the borehole diameter and the outside diameter of the stabilizer. The direction of offset is variable and generally cannot be predicted. Moreover, the stabilizer is typically free to move and vibrate in the borehole since it is under gauge. These difficulties become more significant in oversize boreholes (e.g., due to washout of a soft formation) and upon stabilizer wear (which decreases the effective diameter of the stabilizer). Large radial vibrations and shock loads are known to occur within this freedom movement. Steering difficulties are also encountered as the near-bit stabilizer no longer pivots predictably. It will therefore be understood that there is a need an adjustable near-bit stabilizer.

Adjustable stabilizer mechanisms are well known and commonly used in downhole tools. Adjustable stabilizers can commonly be classified in one of two groups: (i) those that do not rotate with the drill string and (ii) those that are rotationally fixed to the drill string and therefore rotate in the borehole. Commercially available rotary steerable tools, such as the Pathfinder Energy Services Pathmaker® tool, are examples of stabilizers that may be classified in the first group. The Pathmaker® tool automatically and uniquely adjusts the extension of each of three extendable and retractable blades to maintain the tool at a predetermined offset and direction relative to the center of the borehole. As is well known to those of ordinary skill in the art, rotary steerable tools require an electronic (smart) control system (e.g., including one or more microprocessors as well as numerous electronic sensors) to continually adjust the extension of the blades and to maintain the predetermined offset and direction. While rotary steerable tools are known to provide excellent steerability in certain drilling conditions and automatically adjustable stabilization, they are not suitable for many downhole applications (owing in part to the high cost of such tool deployments).

Adjustable stabilizers that are rotationally fixed to the drill string are also known. For example, U.S. Pat. No. 6,732,817 discloses an expandable underreamer and/or stabilizer that may be adjusted from the surface. The tool includes moveable arms that alternate between collapsed and expanded positions in response to differential fluid pressure between the flow bore and the wellbore. U.S. Pat. No. 5,318,138 discloses an adjustable blade stabilizer including a plurality of blades in an angled track that permits radial movement of the blades. The blades are driven by drilling fluid pressure and are radially limited by a positioning piston. The positioning piston is located in the track in response to a command signal received from the surface. This system is capable of setting the stabilizer diameter to a plurality of discrete diameters (rather than a continuum) and utilizes mud pulse communication to set the stabilizer diameter. The system therefore requires the drilling fluid flow to be stopped and started in order to reset the stabilizer diameter.

While adjustable, rotationally fixed stabilizers are known, for example, as described above, they do not provide for automatic adjustment to the borehole diameter. There exists a need in the art for an automatically adjustable stabilizer and, in particular, an adjustable stabilizer that does not require interruption to the normal drilling process.

SUMMARY OF THE INVENTION

The present invention addresses the above described need for an automatically adjustable stabilizer. Exemplary stabilizer embodiments in accordance with the present invention include a plurality of fixed blades, each of which includes at least one automatically extendable and retractable piston. In use, a balance of forces determines the radial position of each piston; a hydraulic force urging the piston outward, a spring force urging the piston inward, and external forces acting on the tool (e.g., the force of the borehole wall urging the pistons inward). The stabilizer is further configured such that a balance of forces between the pistons causes the tool to be automatically and continuously centered during rotation of the tool in the borehole. The inventive stabilizer is purely mechanical (including no electronic and/or electrical control elements), using a differential force in each of the pistons to push against the formation and thereby center the tool.

Exemplary embodiments of the present invention may advantageously provide several technical advantages. For example, exemplary embodiments of this invention provide an adjustable stabilizer that is automatically and continuously adjustable during use. As such, the invention is suitable for use in boreholes that rapidly change size and shape. Moreover, the inventive stabilizer operates without any resetting from the surface or stoppage in drilling. Thus, valuable rig time tends to be preserved.

In one aspect the present invention includes a downhole tool. The tool includes a downhole tool body disposed to be rotatably coupled with a drill string. At least three blades are fixed to and extend radially outward from the tool body. At least one piston is deployed in each of the blades. The pistons are disposed to displace between radially opposed retracted and extended positions. At least one spring member is deployed in each piston, the spring member disposed to exert a spring force that elastically spring biases the piston radially inward towards the retracted position. A hydraulic actuation module is disposed to exert a hydraulic force that urges each piston radially outward against the spring force towards the extended position. The spring force and the hydraulic force are preselected such that they balance external forces acting on the piston during rotation of the tool in a subterranean borehole. The balance of forces causes the tool to be continually urged towards a center of the borehole during rotation of the tool in the borehole.

In another aspect the invention includes a downhole tool. The tool includes a downhole tool body disposed to be rotatably coupled with a drill string. At least three blades are fixed to and extend radially outward from the tool body. At least one piston is deployed in each of the blades. The pistons are disposed to displace between radially opposed retracted and extended positions and are able to exert sufficient outward force to overcome a centrifugal force on the tool caused by eccentric rotation of the tool in the borehole. At least one spring member is deployed in each piston. The spring member is disposed to elastically spring bias the piston radially inward towards the retracted position. The spring member is configured to exert a spring force that is greater than a centrifugal force caused by a predetermined maximum eccentric rotation of the tool in a borehole. A hydraulic actuation module is disposed to exert a hydraulic force that extends each piston radially outward against the spring bias towards the extended position.

In a further aspect the invention includes a downhole tool. The tool includes a downhole tool body disposed to be rotatably coupled with a drill string. At least three blades are fixed to and extend radially outward from the tool body. At least one piston is deployed in each of the blades, the pistons disposed to displace between radially opposed retracted and extended positions. At least one spring member is deployed in each piston, the spring member being disposed to elastically bias the piston radially inward towards the retracted position. A hydraulic actuation module is disposed to extend each piston radially outward against the spring bias towards the extended position. Each piston includes a hydraulic fluid circuit in which a flow restrictor is deployed in parallel with a check valve. The flow restrictor is disposed to restrict fluid flow from the piston to the hydraulic actuation module and the check valve is disposed to permit fluid flow only from the hydraulic actuation module to the piston.

The foregoing has outlined rather broadly the features of the present invention in order that the detailed description of the invention that follows may be better understood. Additional features and advantages of the invention will be described hereinafter which form the subject of the claims of the invention. It should be appreciated by those skilled in the art that the conception and the specific embodiments disclosed may be readily utilized as a basis for modifying or designing other methods, structures, and encoding schemes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
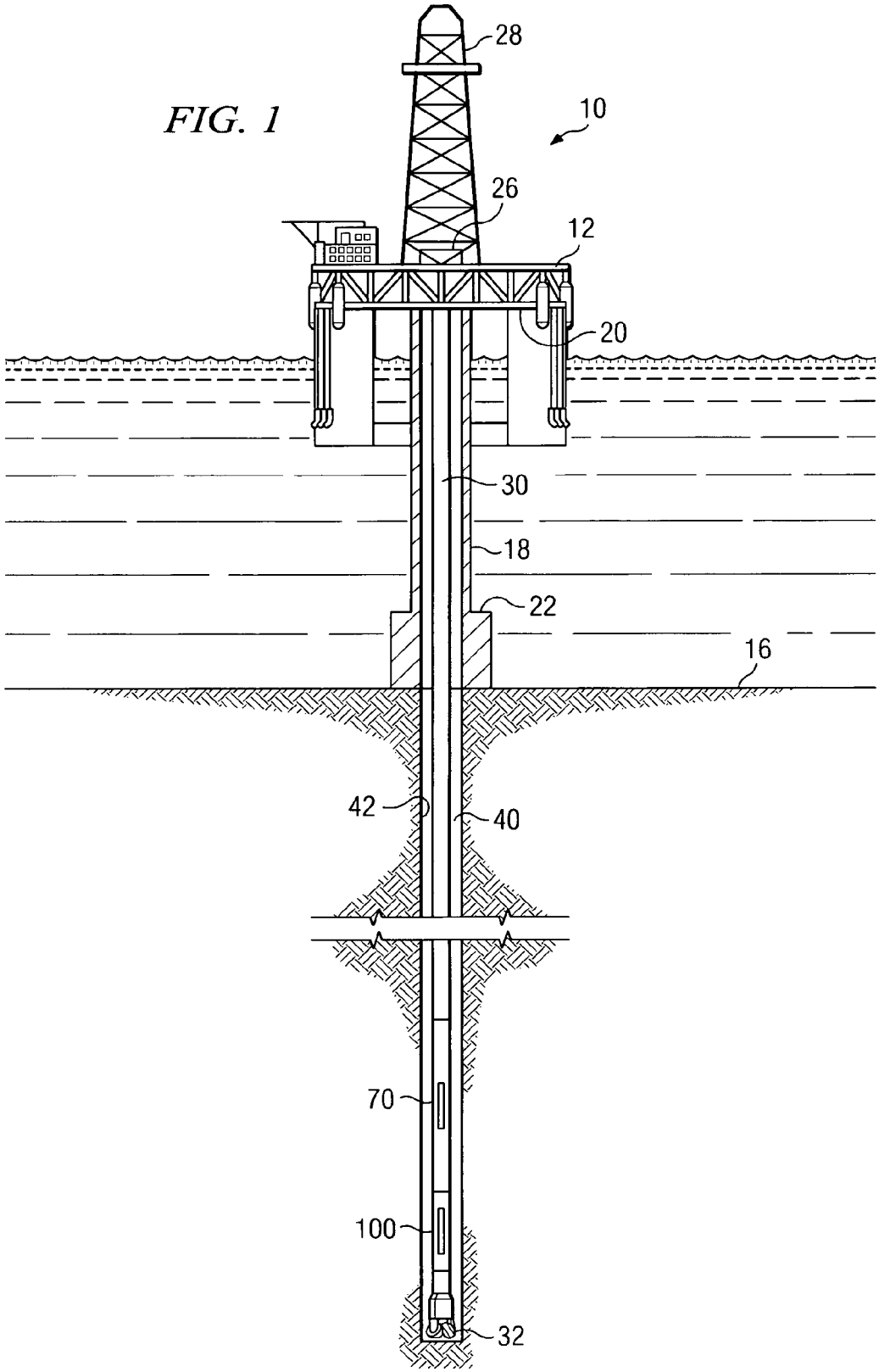
FIG. 1 depicts a drilling rig on which exemplary embodiments of the present invention may be deployed.

Referring first to FIGS. 1 through 10B, it will be understood that features or aspects of the embodiments illustrated may be shown from various views. Where such features or aspects are common to particular views, they are labeled using the same reference numeral. Thus, a feature or aspect labeled with a particular reference numeral on one view in FIGS. 1 through 10B may be described herein with respect to that reference numeral shown on other views.

FIG. 1 illustrates a drilling rig 10 suitable for utilizing exemplary stabilizer and hydraulic control system deployments of the present invention. In the exemplary embodiment shown on FIG. 1, a semisubmersible drilling platform 12 is positioned over an oil or gas formation (not shown) disposed below the sea floor 16. A subsea conduit 18 extends from deck 20 of platform 12 to a wellhead installation 22. The platform may include a derrick 26 and a hoisting apparatus 28 for raising and lowering the drill string 30, which, as shown, extends into borehole 40 and includes a drill bit 32 and a rotatable stabilizer 100 in accordance with one exemplary embodiment of the invention deployed just above the drill bit 32. Exemplary embodiments of stabilizer 100 may advantageously be utilized as a near-bit stabilizer in combination with a steering tool 70 (e.g., including a two- or three-dimensional rotary steerable tool), although the invention is not limited in this regard.

It will be understood by those of ordinary skill that the present invention is not limited to use with a semisubmersible platform 12 as illustrated in FIG. 1. This invention is equally well suited for use with any kind of subterranean drilling operation, either offshore or onshore. While exemplary embodiments of this invention are described below with respect to near-bit stabilizer embodiments, it will also be appreciated that the invention is not limited in this regard. Embodiments of the invention may include substantially any rotatable downhole stabilizer including, for example, a bottom hole assembly (BHA) stabilizer.

Figure 2:
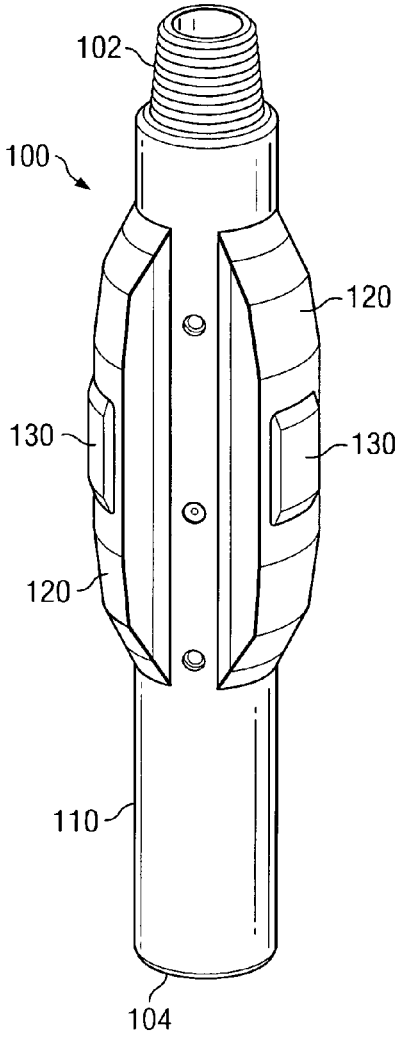
FIG. 2 is a perspective view of one exemplary embodiment of the invention shown on FIG. 1 depicted as a near-bit stabilizer.

Turning now to FIG. 2, one exemplary embodiment of stabilizer 100 from FIG. 1 is illustrated in perspective view. In the exemplary embodiment shown, stabilizer 100 is substantially cylindrical and includes threaded ends 102 and 104 for connecting the stabilizer with a drill string or with other bottom hole assembly (BHA) components (e.g., connecting with the drill bit 32 at end 104 and a steering tool 70 at end 102 as shown on FIG. 1). Stabilizer 100 is thus configured to rotate with the drill string. Stabilizer 100 further includes a substantially cylindrical housing 110 and at least three fixed blades 120. In the exemplary embodiment shown blades 120 are integral with the housing 110, however, the invention is not limited in this regard. Each of the blades 120 includes at least one piston 200 (shown, for example, on FIGS. 3A and 3B) disposed to extend radially outward from and retract radially inward towards the blade 120. As described in more detail below with respect to FIGS. 3A through 6, pistons 200 are urged radially outward via hydraulic force and are simultaneously urged radially inward via spring force. In the exemplary embodiment shown, each blade 120 includes a piston cover 130 deployed over the piston. Piston covers 130 are disposed to contact the borehole wall upon extension of the piston 200 and may advantageously be fabricated from and/or coated with a conventional wear resistant material. The invention, however, is not limited to embodiments including a wear pads or piston covers 130 as shown on FIG. 2.

The exemplary stabilizer embodiment 100 shown on FIGS. 1 and 2 is configured as a near-bit stabilizer and is intended to be deployed in a BHA immediately above the drill bit, e.g., between a drill bit and a steering tool in a point-the-bit steering tool configuration. While the invention is not limited to near-bit stabilizer embodiments, and may be utilized substantially anywhere in the BHA, such near-bit stabilizer embodiments are particularly advantageous. For example, stabilizer 100 is configured to quickly accommodate variations in the borehole diameter without losing contact with the borehole wall (due to the extendable and retractable pistons). Continual contact with the borehole wall tends to minimize radial shock and vibration levels and therefore tends to minimize BHA damage during drilling. Continual contact with the borehole wall also tends to improve the steerability of rotary steerable tools used in conjunction with the inventive stabilizer.

Stabilizer 100 is intended to continually contact the borehole wall during operation. In combination, the pistons 200 automatically and continuously maintain the center of the stabilizer 100 at or near the center of the borehole without any resetting, stopping and starting of drilling, and without any electronic (smart) control. The inventive stabilizer 100 is purely mechanical, using a differential force in the pistons 200 to push against the formation and thereby center the tool. A balance of forces determines the radial position of each piston; a hydraulic force urging the piston outward, a spring force urging the piston inward, and external forces acting on the tool (e.g., the force of the borehole wall urging the pistons inward). Moreover, the stabilizer 100 is configured such that a balance of forces between the pistons causes the tool to be continuously centered during rotation of the tool in the borehole. This balance of forces is discussed in more detail below with respect to FIGS. 5A, 5B, and 6.

Figure 3A:
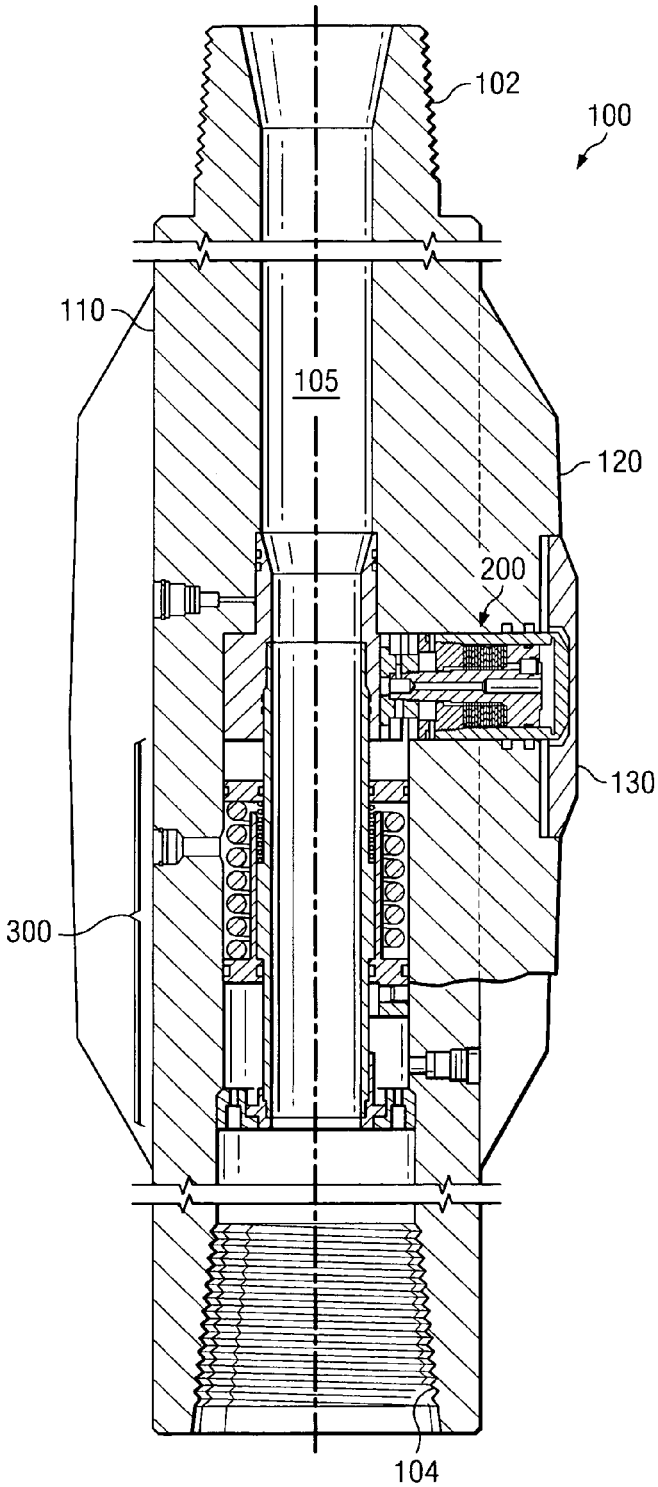
FIGS. 3A and 3B depict, in longitudinal cross section, the exemplary near-bit stabilizer embodiment shown on FIG. 2 in which a piston is shown fully extended (FIG. 3A) and fully retracted (FIG. 3B).
Figure 3B:
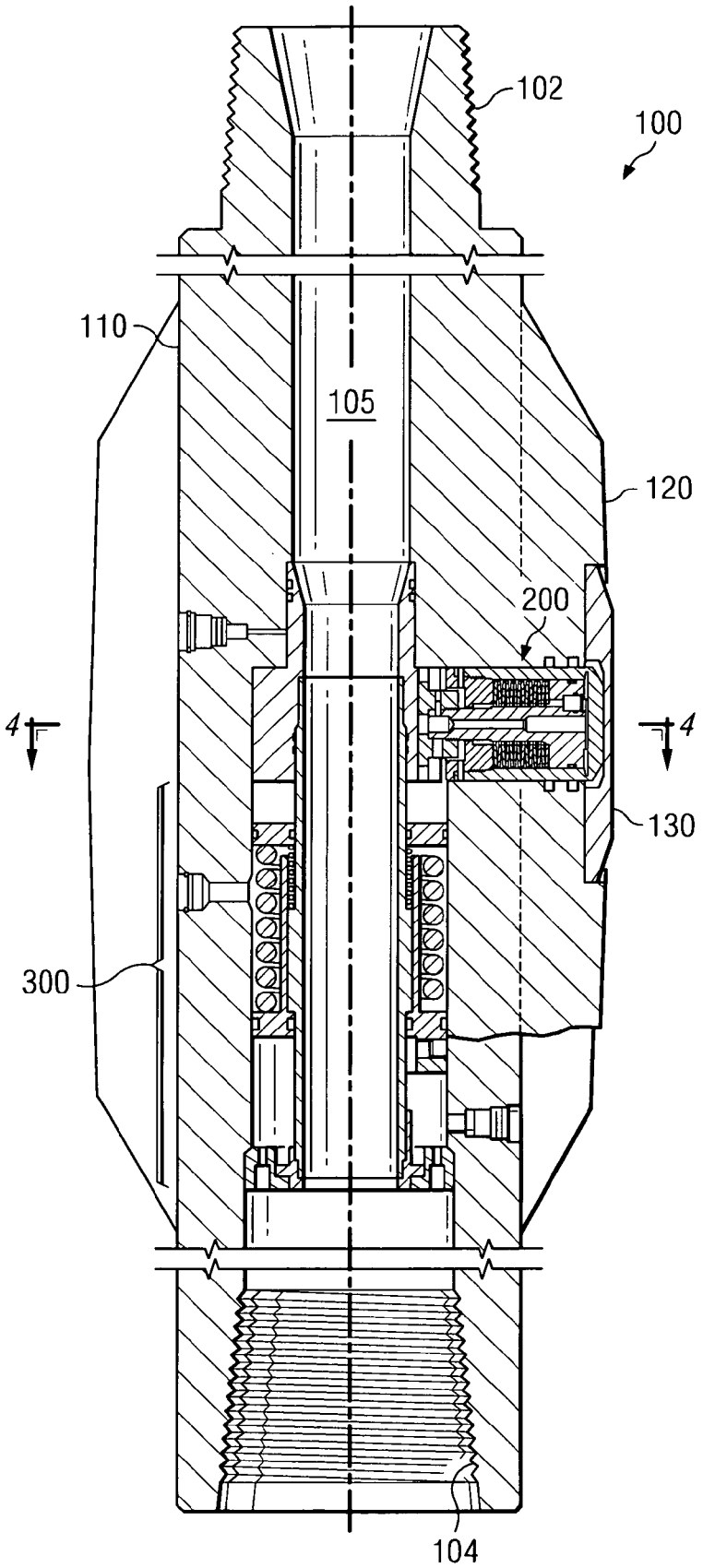
Figure 4:
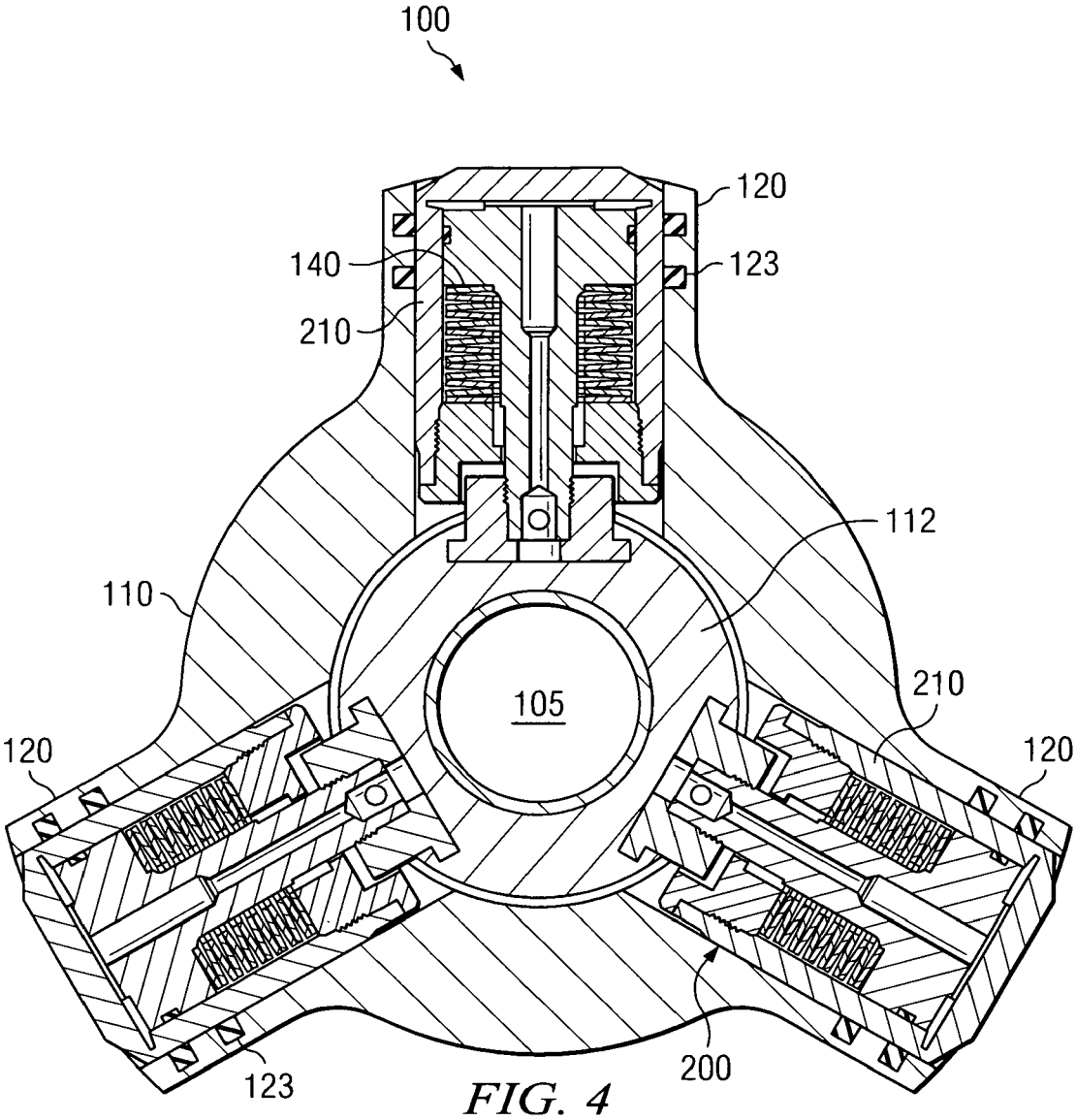
FIG. 4 depicts a circular cross section of the embodiment shown on FIG. 3B but not including piston covers 130.

Turning now to FIGS. 3A, 3B, and 4, stabilizer 100 is shown in longitudinal cross section with piston 200 shown fully extended (FIG. 3A) and fully retracted (FIG. 3B) and in circular cross section with the pistons 200 shown fully retracted (FIG. 4). As described above, steering tool 100 includes at least three fixed blades 120 integral with the tool housing 110 (three in the exemplary embodiment shown on FIG. 4). It will be understood that the invention is not limited to embodiments in which the blades 120 are integral with the housing 110. The blades 120 may, of course, be fixed to the housing 100 via other known mechanical coupling techniques. The fixed blades 120 are typically, although not necessarily, sized and shaped such that an effective outside diameter of the blades 120 is in the range from about 0.005 to 0.5 inch under gage (i.e., smaller) than an expected borehole diameter. Each fixed blade 120 includes at least one piston 200 disposed to extend radially outward (as shown on FIG. 3A) into contact with a borehole wall. The pistons 200 are typically, although not necessarily, configured to have a full outward extension beyond an outer surface of the blade 120 in the range from about 0.25 to about 1 inch. Steering tool 100 further includes hydraulic module 300 for providing high pressure hydraulic fluid to the pistons 200. The hydraulic fluid is intended to urge the pistons radially outward against a spring bias as described in more detail with respect to FIGS. 5A, 5B, and 6. Exemplary hydraulic module 300 embodiments are described in more detail below with further reference to FIGS. 8A through 10B.

Figure 5A:
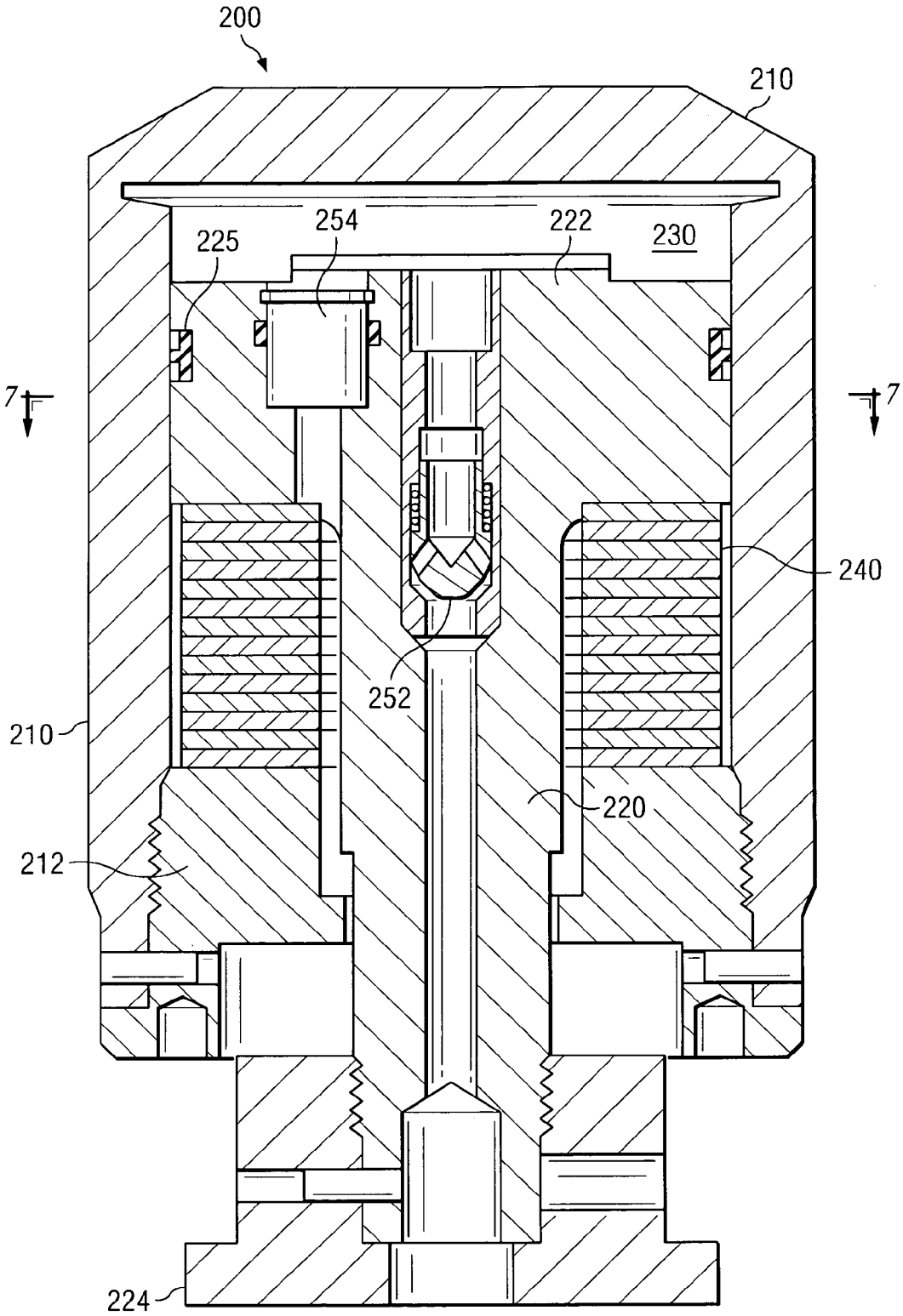
FIGS. 5A and 5B depict an exemplary piston embodiment in accordance with the invention in which the piston is shown fully extended (FIG. 5A) and fully retracted (FIG. 5B).
Figure 5B:
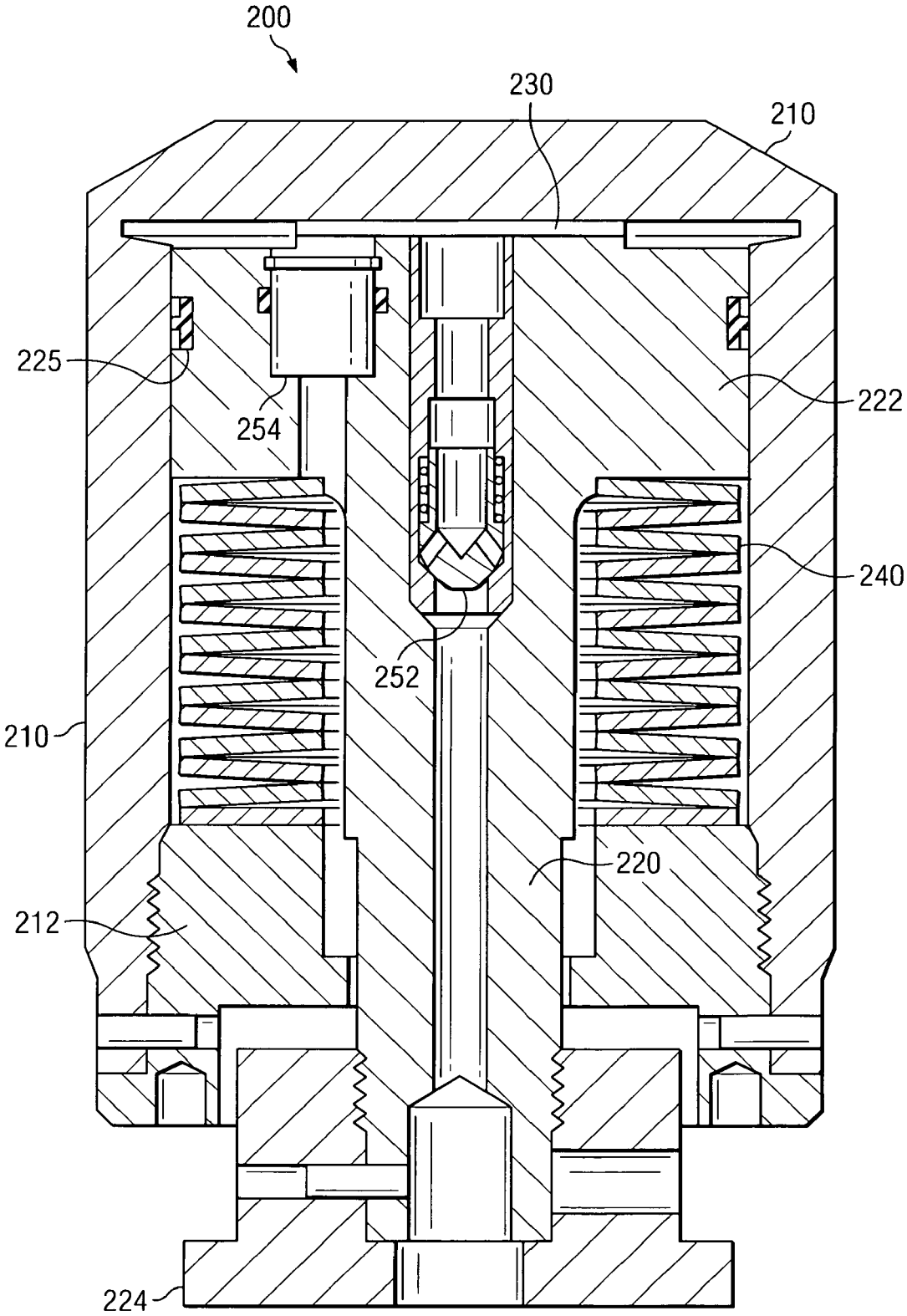

With further reference now to FIGS. 5A and 5B, one exemplary embodiment of piston 200 is shown in greater detail (FIG. 5A shows the piston fully extended while FIG. 5B shows the piston fully retracted). In the exemplary embodiment shown piston 200 includes a piston housing 210 deployed about a support 220. Piston housing 210 may be configured to engage piston cover 130 (e.g., as shown on FIGS. 3A and 3B) or alternatively may be configured to directly contact the borehole wall (e.g., as shown on FIG. 6). The invention is not limited in these regards.

Support 220 includes a support top 222 deployed in the piston housing 210 and a support base 224 rigidly connected to a piston assembly locking sleeve 112 which is deployed in and fixed to the steering tool body 110 (see FIG. 4). An outer surface of the support top 222 is sealingly engaged with an inner surface of housing 210, for example, as shown at 225. An outer surface of the piston housing 210 is also sealingly engaged with the blade 120 as shown at 123 (FIG. 4). Piston housing 210 and preload sleeve 212 are disposed to move radially outward relative to the support 220 as shown in FIG. 5A. Piston 200 further includes a hydraulic chamber 230 disposed to be filled with high pressure hydraulic fluid (supplied for example via hydraulic module 300 shown on FIGS. 3A and 3B). In the exemplary embodiment shown a spring 240 (e.g., a Bellville spring) is deployed between the support top 222 and preload sleeve 212, biasing the piston housing 210 radially inward towards support top 222 (the fully retracted position shown in FIG. 5B). Filling the hydraulic chamber 230 with hydraulic fluid extends the piston housing 210 outward thereby closing spring 240 against its bias.

The force applied radially outward by each of the pistons may be expressed mathematically, for example, as follows:

$$F_P = F_H - F_S \qquad \text{Equation 1}$$

where $F_P$ represents the outward force of the piston, $F_H$ represents the hydraulic force urging the piston radially outward, and $F_S$ represents the spring force urging the piston radially inward. In preferred embodiments, the hydraulic force $F_H$ is substantially constant while the spring force $F_S$ increases approximately linearly as the piston is extended against the bias of spring 240 (by substantially constant it is meant that variations in the hydraulic force are much less than the increase and decrease in the spring force caused by extension and retraction of the piston 200). In such embodiments, the outward force of the piston $F_P$ decreases approximately linearly with increasing extension thereof (due to the increasing spring force and the substantially constant hydraulic force). It will thus be understood that a fully retracted piston exerts a significantly greater outward force than a fully extended piston. In one advantageous embodiment, the spring force $F_S$ is near zero when the piston is fully retracted (as compared to the spring force when the piston is fully extended) and the piston force $F_P$ is near zero when the piston is fully extended (as compared to the piston force when the piston is fully retracted).

Figure 6:
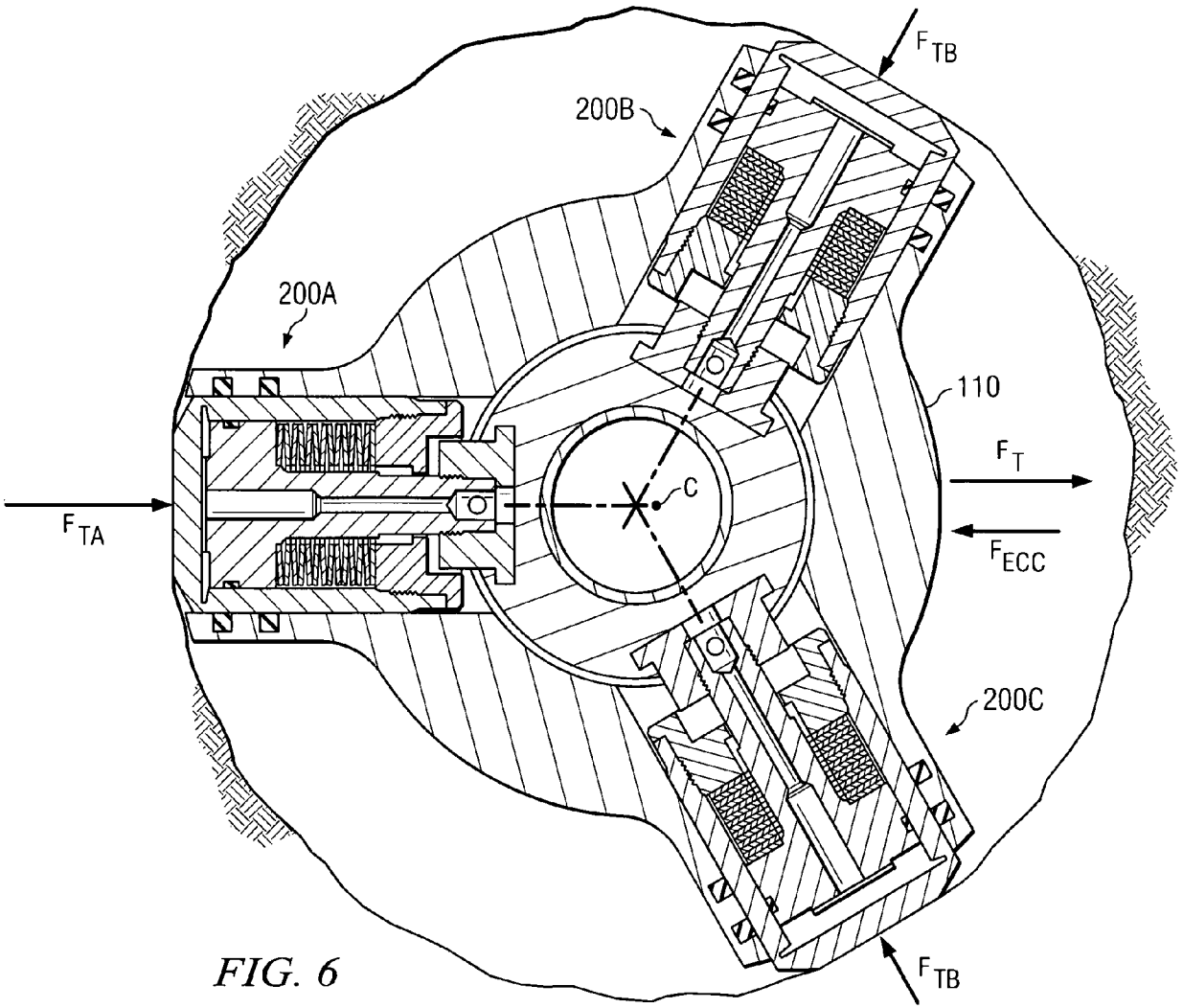
FIG. 6 depicts, in circular cross section, the embodiment show on FIG. 4 deployed off-center in a borehole.

Turning now to FIG. 6, steering tool 100 is shown in circular cross section deployed off-center (eccentered) in a borehole. In the exemplary embodiment shown, piston 200A is fully retracted while pistons 200B and 200C are shown fully extended. During the course of drilling, lateral forces (e.g., lateral shocks and vibrations) are commonly encountered and are known to sometimes temporarily eccenter the BHA assembly (including conventional stabilizers). Such eccentering of the BHA components is especially problematic in oversized boreholes in which conventional fixed stabilizer blades no longer continually contact the borehole wall. As described above, stabilizer embodiments in accordance with this invention advantageously tend to resist eccentering and continually and automatically re-center themselves (in the event they are off-center). This "center seeking" behavior is the result of a balance of forces between the pistons (e.g., pistons 200A-C in FIG. 6).

With continued reference to FIG. 6, the outward forces of each of the pistons 200A-C on the borehole wall result in equal and opposite radially inward forces acting on the tool body 110. These forces are designated as $F_{TA}$ $F_{TB}$, and $F_{TC}$ in FIG. 6. As shown, the magnitude of force $F_{TA}$ at piston 200A is significantly greater than the magnitudes of forces $F_{TB}$ and $F_{TC}$ at 200B and 200C (since piston 200A is retracted and pistons 200B and 200C are extended). As a result, the sum of forces $F_{TA}$, $F_{TB}$, and $F_{TC}$ (designated as $F_T$ in FIG. 6) is non-zero and in the exemplary embodiment shown is directed such that it urges the tool 100 radially inward towards the center C of the borehole. If $F_T$ is greater than the centrifugal force $F_{ECC}$ urging tool body 110 radially outward away from the center of the borehole, then the stabilizer 100 tends to automatically re-center itself during rotation in the borehole. Those of ordinary skill in the art will readily recognize that eccentric rotation of tool 100 in the borehole results in a centrifugal force $F_{ECC}$ urging tool body 110 radially outward (away from the center of the borehole).

It will be understood that FIG. 6 is schematic in nature and depicts a simplified scenario. In actuality the drill string (and therefore stabilizer 100) is rotating and/or whirling in the borehole. Therefore the re-centering process described above tends to be dynamic. Notwithstanding, so long as the magnitude of force $F_T$ is greater than the magnitude of force $F_{ECC}$ then stabilizer 100 advantageously tends to continuously and automatically "seek" the center of the borehole. Stated another way, the above described balance of forces between the pistons tends to cause under-extended (over-retracted) pistons to extend relative to overextended pistons. This "extending" of the under-extended pistons tends to re-center the stabilizer 100.

In order for the stabilizer 100 to effectively re-center, the pistons 200 must be able to exert sufficient force to overcome the centrifugal force acting on the tool body (e.g., in the exemplary embodiment shown on FIG. 6: $F_{TA}$ must be greater than $F_{ECC}$). This can be achieved, for example, by utilizing a hydraulic module 300 (FIGS. 3A and 3B) providing sufficient hydraulic pressure. In one advantageous embodiment, the pistons 200 are configured such that the spring 240 exerts a spring force at any extension that is greater than or equal to the centrifugal force acting on the tool 100 due to eccentric rotation of the tool 100 in the borehole. This may be expressed mathematically, for example, as follows:

$$F_S \geqq F_{ECC} \qquad \text{Equation 2}$$

where $F_S$ represents the spring force and $F_{ECC}$ represents the centrifugal force acting on the tool due to eccentric rotation in the borehole. If piston 200 is configured such that the spring force is near zero when the piston is fully retracted then the spring force $F_S$ may be expressed mathematically, for example, as follows:

$$F_S = K_S r_{piston} \qquad \text{Equation 3}$$

where $K_S$ represents the spring constant (also referred to herein as the spring rate) and $r_{piston}$ represents the outward extension of the piston from the fully retracted position against the bias of spring 240. The centrifugal force due to eccentric rotation of the tool 100 in the borehole may be expressed mathematically, for example, as follows:

$$F_{ECC} = m\omega^2 r_{eccenter} \qquad \text{Equation 4}$$

where m represents the mass of the tool rotating off center, ω represents the angular velocity of the tool in units of radians, and $r_{eccenter}$ represents the tool offset from the center of the borehole (i.e., the radial distance between the center of the tool and the center of the borehole). Equation 1 may then be rewritten as follows:

$$K_S r_{piston} \geqq m\omega^2 r_{eccenter} \qquad \text{Equation 5}$$

In general, the outward extension of the piston $r_{piston}$ may be thought of as being approximately equal to the tool offset $r_{eccenter}$. Thus, in the above described exemplary embodiment, spring 240 is configured to have a spring constant $K_S$ that exceeds the maximum expected $m\omega^2$ based on known/expected service conditions. By pre-selecting the spring constant, optimum centering can be achieved for predetermined tool parameters and service conditions (weight and an expected maximum rpm). For example, for a tool (or BHA) having a mass of about 1300 lbs and a maximum serviceable rotation rate of about 300 rpm, an advantageous spring constant may be greater than about 3300 lbs/in.

Figure 7:
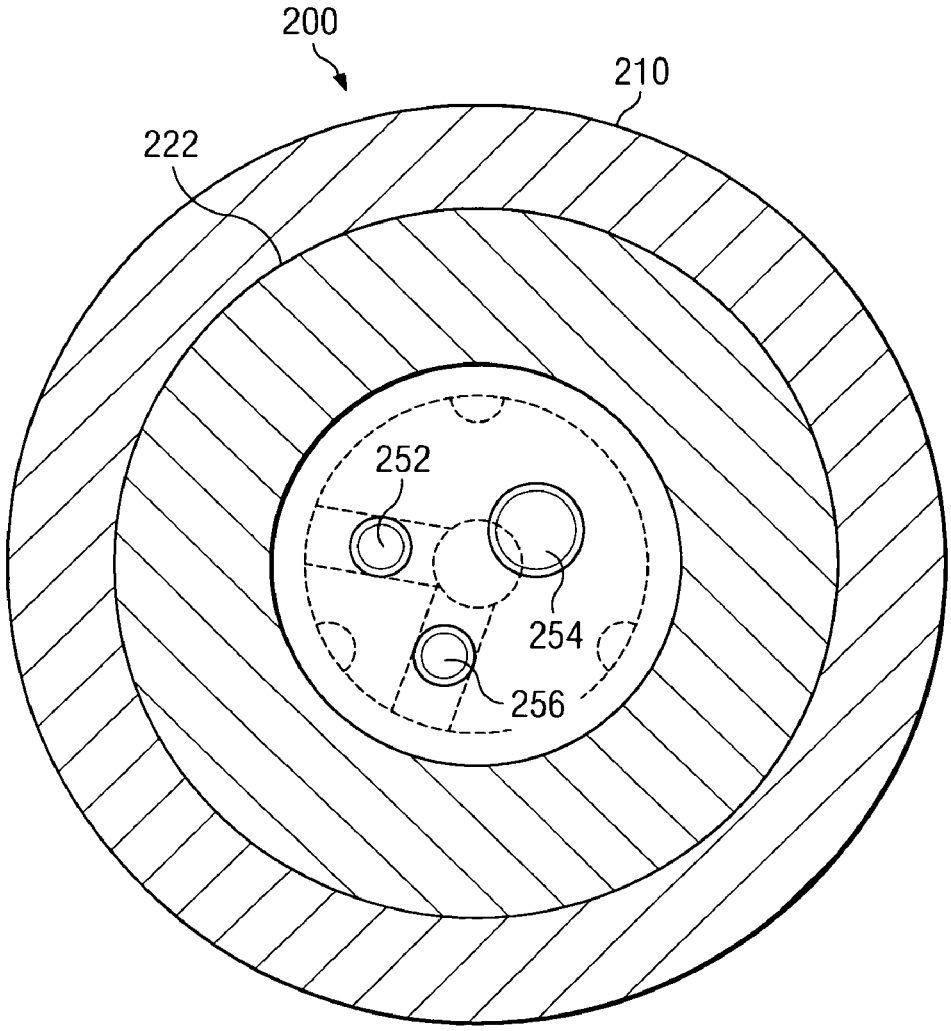
FIG. 7 depicts a circular cross section of the piston embodiment shown on FIG. 5A.

Turning now to FIG. 7, one exemplary embodiment of piston 200 is shown in circular cross section. The exemplary embodiment shown includes three parallel flow paths between hydraulic module 300 (FIGS. 3A and 3B) and hydraulic fluid chamber 230 (FIGS. 5A and 5B). The first flow path includes a check valve 252 deployed therein, the check valve 252 being disposed to permit flow from the hydraulic module 300 to the hydraulic fluid chamber 230. Reverse flow is blocked. The second flow path includes a flow restrictor 254 deployed therein. The flow restrictor allows (but restricts) flow volume in both directions. The third flow path includes a pressure relief valve 256 deployed therein. The pressure relief valve is disposed to permit flow from the hydraulic fluid chamber 230 to the hydraulic module 300 only when the hydraulic pressure in the hydraulic fluid chamber 230 exceeds a predetermined pressure.

The fluid flow configuration described above with respect to FIG. 7 advantageously tends to improve piston performance during operation in a borehole. When there is essentially no external force acting on the piston 200, it extends outward rapidly as pressurized hydraulic fluid moves unimpeded through the check valve 252. However, when an inward force is applied to the piston 200 it moves inward slowly as the hydraulic fluid is forced back towards the hydraulic module through the flow restrictor 254 (reverse flow through the check valve 252 is blocked). Such an arrangement enhances the ability of the stabilizer to remain centered in the borehole as the flow restrictor 254 acts to effectively dampen external shocks and forces that would otherwise rapidly eccenter the tool. In the exemplary embodiment described in FIG. 7, pressure relief valve 256 bypasses the check valve 252 thereby allowing high velocity fluid flow from chamber 230 to hydraulic module, which allows for rapid retraction of the piston 200, in the event of a severe external shock (an external force with a magnitude above a predetermined threshold). The pressure relief valve is therefore intended to minimize piston damage (e.g., damage to the seals) when severe external forces are encountered. While the use of pressure relief valve 256 tends to be advantageous, the invention is not limited in this regard. Nor is the invention limited to the use of any such parallel flow paths as depicted on FIG. 7.

Figure 8A:
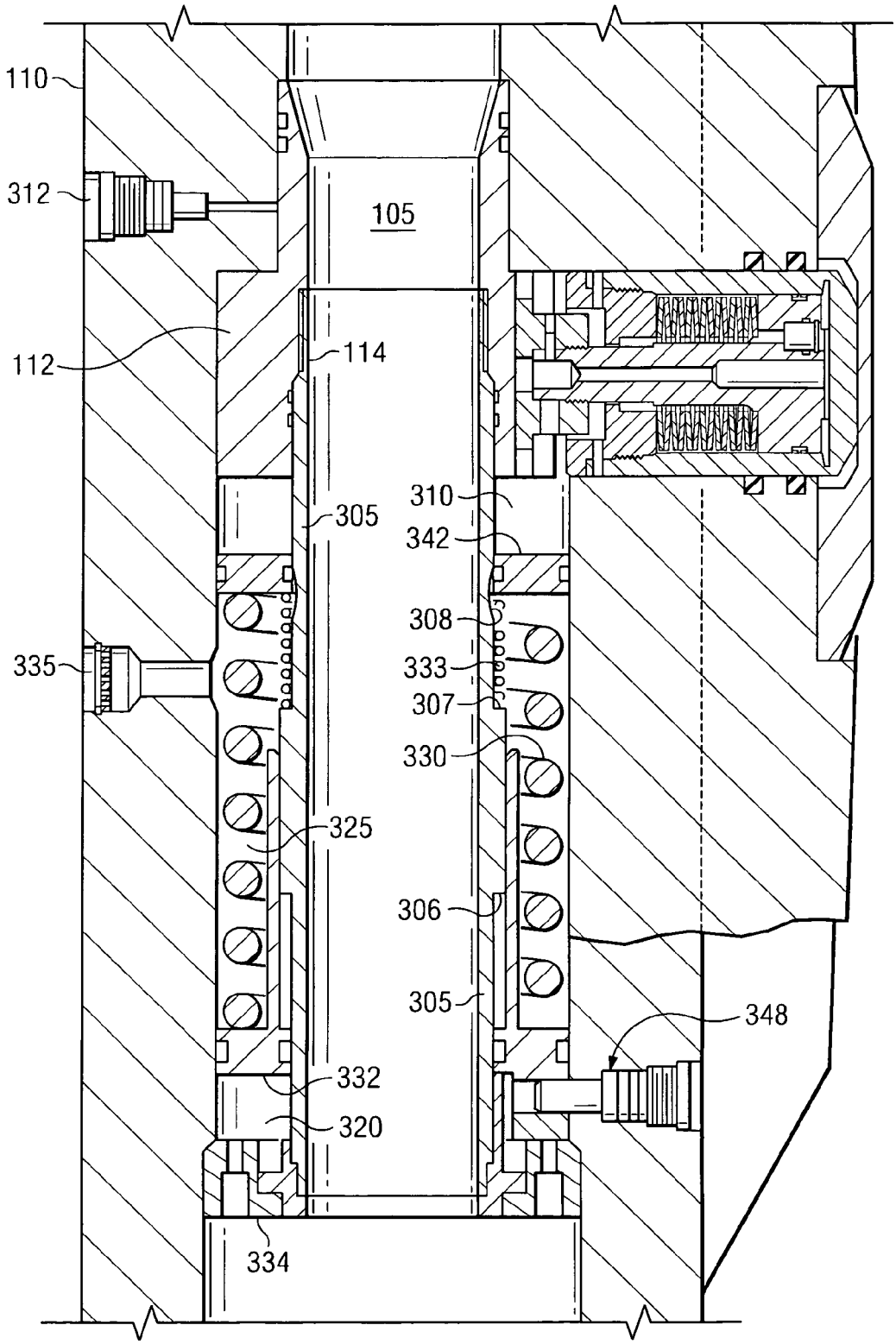
FIGS. 8A and 8B depict, in longitudinal cross section, a portion of the exemplary near-bit stabilizer embodiment shown on FIGS. 3A and 3B having a non-activated (FIG. 8A) and activated (FIG. 8B) hydraulic system.
Figure 8B:
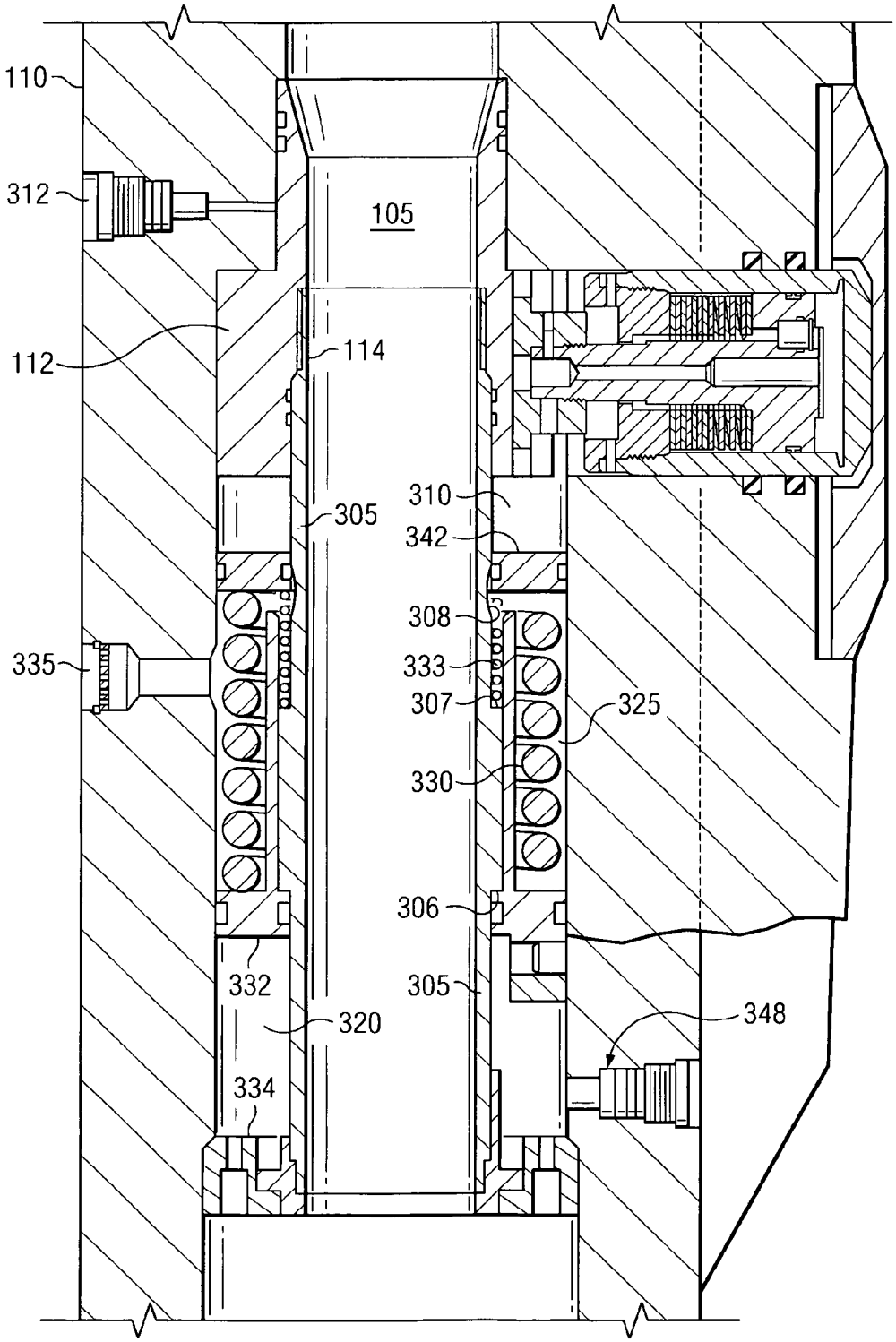

With reference now to FIGS. 8A and 8B, one exemplary embodiment of hydraulic module 300 is described in more detail. While hydraulic module 300 is shown deployed in a stabilizer, it will be appreciated that hydraulic modules in accordance with the present invention may be deployed in any downhole tool in which substantially constant pressure hydraulic fluid is desirable. In FIG. 8A, hydraulic module 300 is shown de-activated, while in FIG. 8B hydraulic module 300 is shown activated (FIGS. 3A and 3B also depict an activated hydraulic module 300). Hydraulic module 300 is configured to convert highly variable drilling fluid pressure (mud pump pressure) in through bore 105 to a near constant pressure hydraulic fluid (by near constant it is meant that the pressure variation in the hydraulic oil is insignificant as compared to the pressure variation in the drilling fluid in through bore 105). In the exemplary embodiment shown, module 300 includes a substantially annular hydraulic fluid chamber 310 and first and second annular drilling fluid chambers 320 and 325 (it will be understood that the invention is not limited to annularly shaped hydraulic and drilling fluid chambers). Chambers 310, 320, and 325 are located radially between an outer surface of sleeve 305 and an inner surface of cylindrical housing 110. In the exemplary embodiment shown, sleeve 305 is connected to piston assembly locking sleeve 112 via a tongue and groove connection shown at 114. The invention is not limited in this regard.

Chamber 310 is typically filled with hydraulic oil, for example, via port 312. Drilling fluid chamber 320 is in fluid communication with drilling fluid being pumped down through bore 105 (in the interior of the tool 100). Drilling fluid chamber 320 extends axially from a positioning piston 332 (on an upper end) to a drilling fluid inlet port 334 (on a lower end). Drilling fluid chamber 325 is in fluid communication with drilling fluid exterior to the tool and extends axially from a system pressure piston 342 (on an upper end) to positioning piston 332 (on the lower end). System pressure piston 342 is deployed between hydraulic fluid chamber 310 and drilling fluid chamber 325.

With continued reference to FIGS. 8A and 8B, hydraulic module 300 further includes a system pressure spring 330 deployed in drilling fluid chamber 325. Spring 330 is located axially between system pressure piston 342 and a positioning piston 332. In the exemplary embodiment shown, positioning piston 332 is disposed to reciprocate axially between the drilling fluid inlet port 334 (as shown on FIG. 8A) and an outer shoulder 306 of sleeve 305 (as shown on FIG. 8B). Prior to activating the hydraulic module 300, system pressure spring 330 urges the positioning piston 332 into contact with the drilling fluid inlet port 334 (FIG. 8A) where it is held securely in place via shear pin 348. The shear pin 348 is configured to shear at a predetermined mud pump pressure. Thus, in the exemplary embodiment shown, the fluid in hydraulic chamber 310 is not pressurized until a predetermined drilling fluid pressure is exceeded (e.g., when the mud pumps are turned on and drilling commences). The use of shear pin 348 advantageously enables the pistons 200 (FIGS. 3A and 3B) to remain retracted (under the bias of Bellville spring 240) while the tool 100 is tripped into the borehole. Such retraction of the pistons 200 tends to promote easy trip in (when under gage fixed blades 120 are utilized as described above) and also reduces the likelihood of piston damage during trip in. Notwithstanding the above described advantages, the invention is not limited to embodiments including a shear pin 348 arrangement.

With reference again to FIG. 8B, after pin 348 is sheared, positioning piston 332 moves upwards into contact with shoulder 306 under the influence of drilling fluid pressure as drilling fluid chamber 320 is filled. Such movement of the positioning piston 332 compresses system pressurizing spring 330, which urges system pressure piston 342 upwards and thereby pressurizes the hydraulic oil in chamber 310. As long as the drilling fluid pressure (mud pump pressure) remains above a minimum threshold, (as is the case in a typical drilling operation), positioning piston 332 remains in place against shoulder 306 and the hydraulic pressure in chamber 310 remains approximately constant. In the exemplary embodiment shown, hydraulic module 300 further includes an exhaust port 335 through which drilling fluid may enter and exit drilling fluid chamber 325. Upon activation of the hydraulic module 300 (e.g., via turning on the mud pumps as described above), excess drilling fluid in chamber 325 exits the tool via port 335 as piston 332 compresses system pressure spring 330. Upon deactivation of the hydraulic module 300 (e.g., when the mud pumps are turned off), drilling fluid enters chamber 325 as spring 330 urges piston 332 towards inlet port 334.

As described above with respect to FIG. 7, BHA tools often experience severe external shocks. For example, shock levels in the range of 1000 G on each axis and vibration levels of 50 G root mean square are sometimes encountered. Use of a pressure relief valve in the pistons (as described above with respect to FIG. 7) is one way such shocks can be accommodated. Exemplary embodiments of hydraulic module 300 may also be configured to accommodate external shocks. For example, in the exemplary embodiment shown FIGS. 8A and 8B, annular sleeve 305 includes an over pressure relief groove 308 formed therein. In the event of a sudden increase in system pressure (in chamber 310), piston 342 translates towards system pressure spring 330 allowing excess system pressure to exhaust through groove 308 into drilling fluid chamber 325. Exemplary embodiments of hydraulic module 300 may also include a secondary spring 333 deployed between the system pressure piston 342 and shoulder 307 of sleeve 305. Secondary spring 333 is configured to apply a nominal force to system pressure piston 342 thereby preventing the piston 342 from translating into the groove 309 when the hydraulic module 300 is deactivated (FIG. 8A). This nominal force also maintains a relatively small positive pressure (as compared to the fully activated pressure) on the hydraulic oil in chamber 310, which is intended maintain a positive pressure on various seals in chamber 310 and piston 200 and prevent contamination of the hydraulic oil with exterior drilling fluid.

Figure 9A:
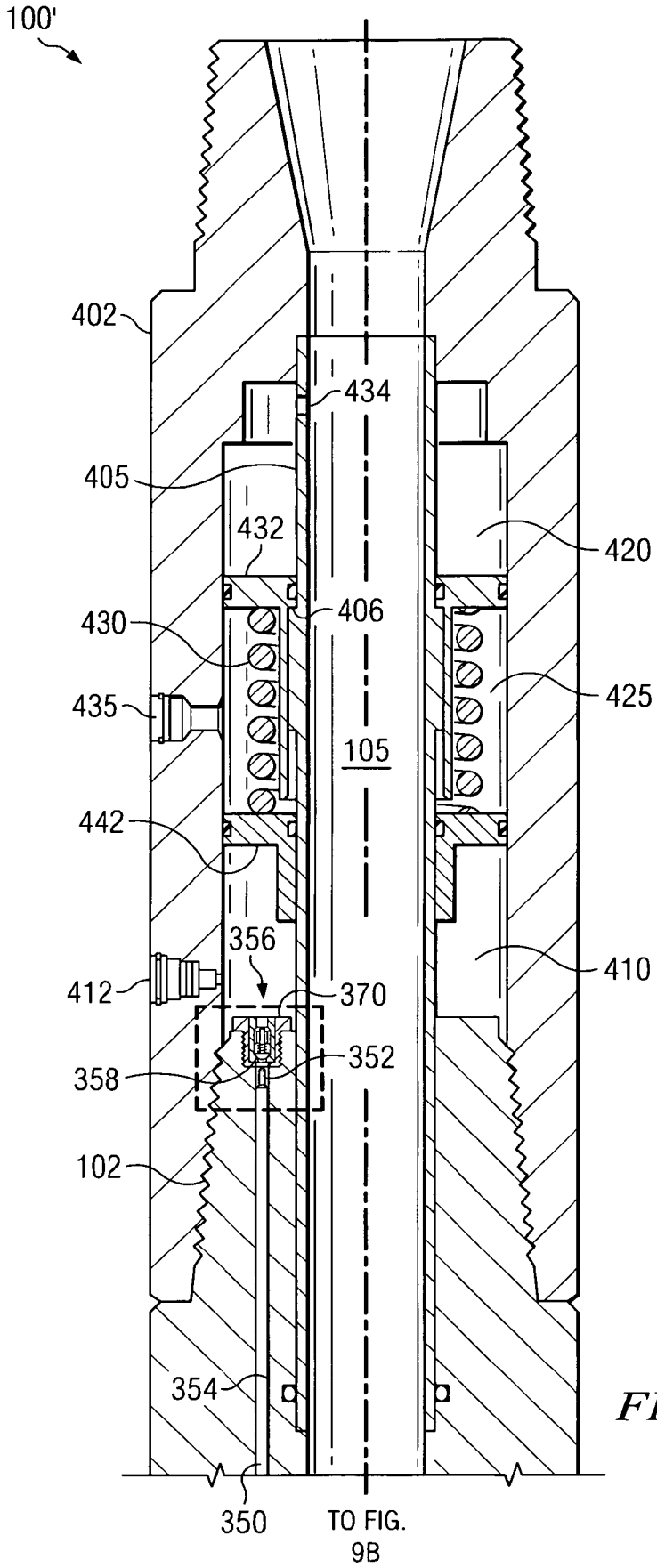
FIGS. 9A and 9B depict, in longitudinal cross section, the exemplary near-bit stabilizer embodiment shown on FIGS. 3A and 3B, connected with a hydraulic oil replenishing sub.
Figure 9B:
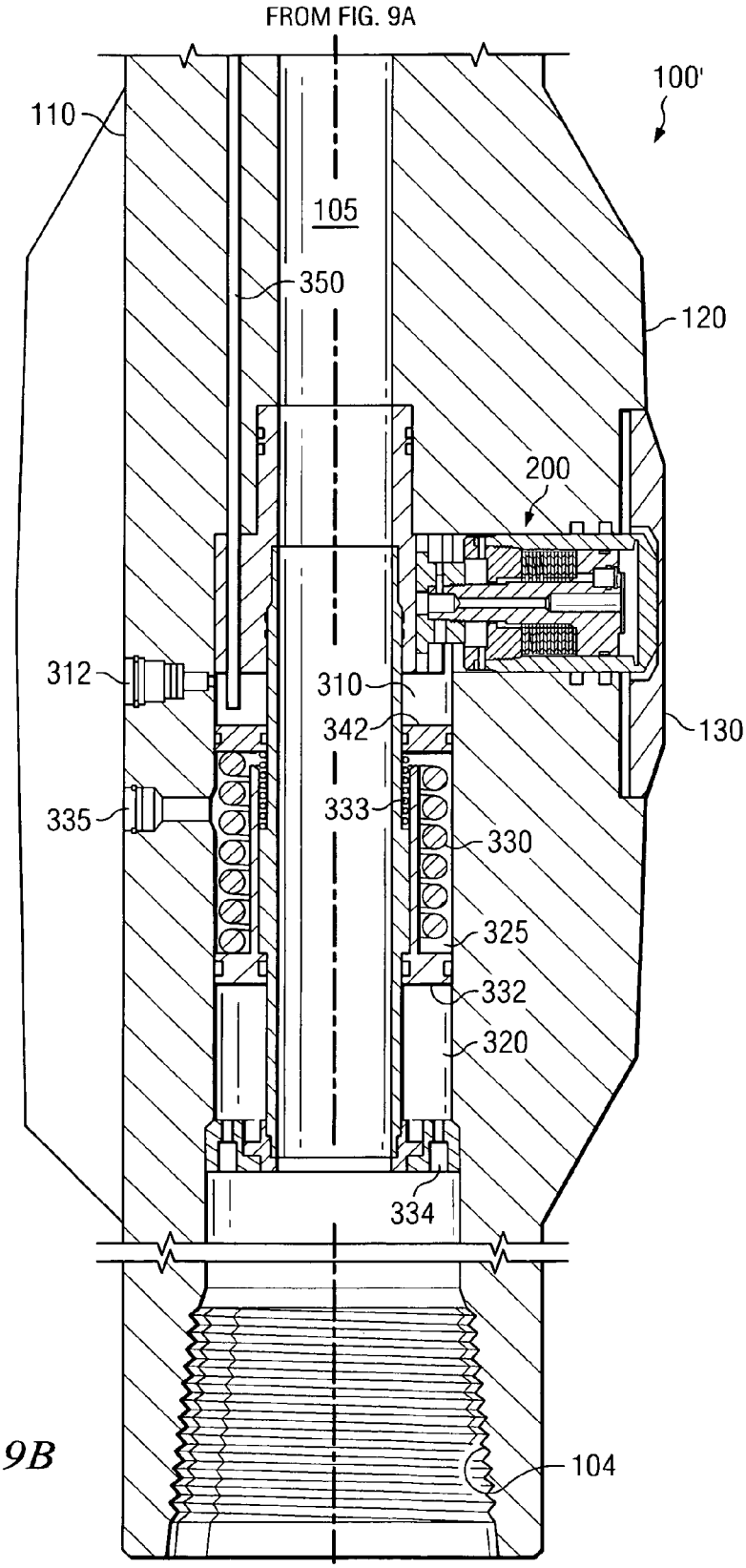

With reference now to FIGS. 9A and 9B, certain exemplary embodiments of hydraulic module 300 (FIG. 3A) may advantageously include or be connected to a hydraulic oil replenishing system 400 to maintain a sufficient quantity of hydraulic oil in module 300. An oil replenishing system tends to advantageously increase the run time of downhole tool 100' since oil can be lost through various seals during operation. One exemplary embodiment of a replenishing sub 400 in accordance with the invention is depicted in FIG. 9A. In the exemplary embodiment shown, replenishing sub 400 is a stand alone module that may be coupled to stabilizer 100' at pin end 102. Replenishing sub 400 is similar to hydraulic module 300 in that it is configured to convert highly variable drilling fluid pressure (mud pump pressure) in through bore 105 to a near constant pressure hydraulic fluid (which is made available to the hydraulic module 300 as described in more detail below). In the exemplary embodiment shown, replenishing sub 400 includes a substantially annular hydraulic fluid chamber 410 and first and second drilling fluid chambers 420 and 425. Chambers 410, 420, and 425 are located radially between an outer surface of sleeve 405 and an inner surface of sub housing 402. Chamber 410 is typically filled with hydraulic oil, for example, via port 412. Drilling fluid chamber 420 is in fluid communication with drilling fluid being pumped down through bore 105 (in the interior of the sub 400). Drilling fluid chamber 420 extends axially from a system positioning piston 432 (on a lower end) to a drilling fluid inlet port 434 (on an upper end). Drilling fluid chamber 425 is in fluid communication with drilling fluid exterior to the tool and extends axially from a system positioning piston 432 (on an upper end) to pressure piston 442 (on the lower end). System pressure piston 442 is deployed between hydraulic fluid chamber 410 and drilling fluid chamber 425.

In the exemplary embodiment shown, replenishing sub 400 further includes a system pressure spring 430 deployed in drilling fluid chamber 425. Spring 430 is located axially between system pressure piston 442 and a positioning piston 432. In the exemplary embodiment shown, positioning piston 432 is disposed to reciprocate axially between the drilling fluid inlet port 434 and an outer shoulder 406 of sleeve 405 (as shown on FIG. 9A). Prior to activating the replenishing system 400, system pressure spring 430 urges the positioning piston 432 into contact with the drilling fluid inlet port 434 where it may optionally be held in place via a shear pin arrangement analogous to that shown at 348 in FIG. 8A. Upon activation of the replenishing system, positioning piston 432 moves downwards into contact with shoulder 406 under the influence of drilling fluid pressure as drilling fluid chamber 420 is filled. Such movement of the positioning piston 432 compresses system pressurizing spring 430, which urges system pressure piston 442 downwards thereby pressuring the hydraulic oil in chamber 410. The exemplary embodiment of replenishing sub 400 shown further includes an exhaust port 435 through which drilling fluid may enter and exit drilling fluid chamber 425.

With continued reference to FIGS. 9A and 9B, the hydraulic module 300 of tool 100' is further configured to be used with (and connected to) the replenishing sub 400. A check (or relief) valve 356 is deployed in the pin end of tool 100' (e.g., in a valve housing 370) such that it permits fluid flow from system chamber 310 in hydraulic module 300 to hydraulic chamber 410 in sub 400. Reverse flow (from chamber 410 to chamber 310) is checked (blocked). An extension rod 350 extends from hydraulic chamber 310 to the check valve 356 through fluid channel 354 where it contacts (or nearly contacts) a sealing ball 358 (see FIG. 10A) in check valve 356. As the hydraulic fluid volume in chamber 310 is depleted (e.g., during a drilling operation), piston 342 moves upwards (owing to the bias of spring 330) towards extension rod 350. When sufficient fluid volume has been depleted from chamber 310, the movement of piston 342 urges extension rod 350 upwards, such that rod end 352 opens check valve 356 (by pushing sealing ball 358 off seat 359). The hydraulic oil in chamber 410 of sub 400 is typically held at a higher pressure than that of chamber 310 so that oil flows from the replenishing sub 400 through valve 356 and channel 354 to the hydraulic module 300 in tool 100' (i.e., from chamber 410 to 310). As chamber 310 refills, piston 342 moves back downwards away from rod 350, which allows the check valve 356 to close such that sealing ball 358 is biased into contact with seat 359 and fluid flow from chamber 410 to chamber 310 is checked.

As described above, check valve is disposed to permit fluid flow from chamber 310 to chamber 410 of the replenishing sub 400. Such flow is restricted during normal tool operations since the pressure in chamber 410 is greater than that in chamber 310. In the event that hydraulic chamber 310 is over filled during tool operation (for example owing to a leaking check valve), such excess fluid tends to flow back into chamber 410 of the replenishing sub 400 through check valve 356 when the hydraulic system is deactivated (e.g., when the mud pumps are turned off).

Figure 10A:
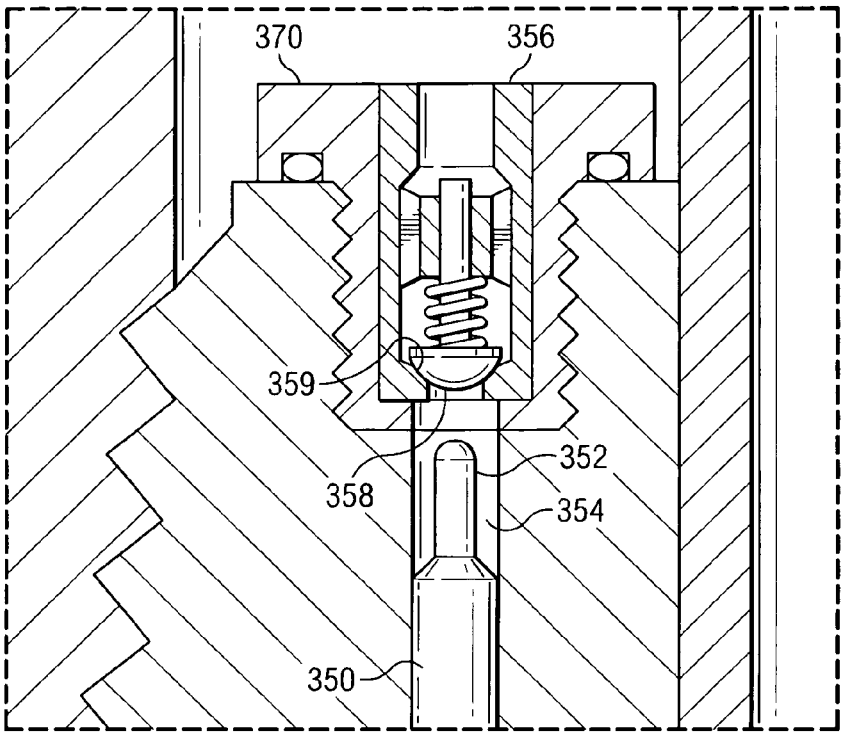
FIG. 10A depicts a detailed view of the check valve assembly 356 shown on FIG. 9.
Figure 10B:
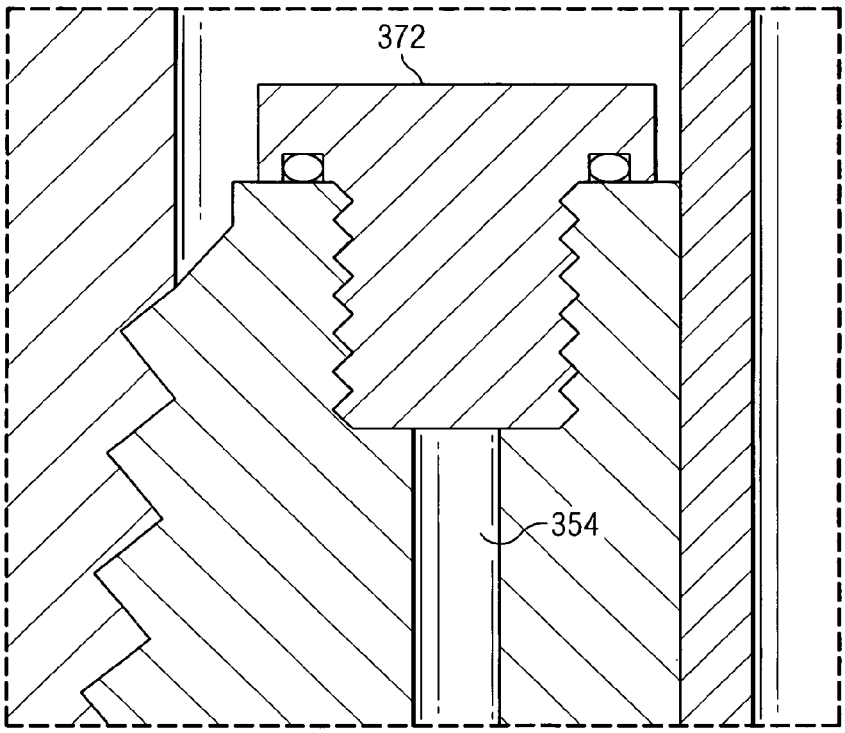
FIG. 10B depicts the same view as shown on FIG. 10A, with the exception that a seal plug 372 has replaced the check valve.

With brief reference now to FIG. 10B, it will be appreciated that the exemplary stabilizer embodiment 100' depicted on FIGS. 9A and 9B may be utilized with or without replenishing a sub 400. FIGS. 9A, 9B, and 10A depict use with the sub 400 (as described above). In the event that the sub 400 is not utilized, a seal plug 372 is deployed in the pin end 102 (replacing valve 356 and valve housing 370). Rod 350 is also removed from channel 354. In such instances, pin end 102 may be connected directly to other downhole tools, e.g., a steering tool (as shown on FIG. 1) or other BHA component.

Although the present invention and its advantages have been described in detail, it should be understood that various changes, substitutions and alternations can be made herein without departing from the spirit and scope of the invention as defined by the appended claims.

I claim:

1. A downhole tool comprising:

a downhole tool body disposed to be rotatably coupled with a drill string;

at least three blades fixed to and extending radially outward from the tool body;

at least one piston deployed in each of the blades, the pistons disposed to displace between radially opposed retracted and extended positions;

at least one spring member deployed in each piston, said spring member disposed to exert a spring force that elastically spring biases the piston radially inward towards the retracted position;

a hydraulic actuation module disposed to exert a hydraulic force that urges each piston radially outward against the spring force towards the extended position; and the spring force and the hydraulic force being preselected such that they balance external forces acting on the piston during rotation of the tool in a subterranean borehole, said balance of forces causing the tool to be continually urged towards a center of the borehole during rotation of the tool in the borehole.

2. The downhole tool of claim 1, wherein the external forces comprise (i) a borehole wall force urging the piston inward towards the retracted position and (ii) a centrifugal force urging the tool radially outward owing to eccentric rotation of the tool in the borehole.

3. The downhole tool of claim 1, wherein said balance of forces causes over-retracted pistons to be continually urged radially outward while over-extended pistons are continually urged radially inward such that each of the pistons is substantially equally displaced.

4. The downhole tool of claim 1, wherein an outward force exerted by each of the pistons decreases substantially linearly with increasing extension thereof.

5. The downhole tool of claim 1, wherein (i) the hydraulic force is substantially constant and (ii) the spring force increases substantially linearly with increasing extension of the pistons.

6. The downhole tool of claim 1, wherein the spring force is greater than a centrifugal force on the tool caused by eccentric rotation of the tool in the borehole.

7. The downhole tool of claim 1, wherein the hydraulic force is greater than a centrifugal force on the tool caused by eccentric rotation of the tool in the borehole.

8. The downhole tool of claim 1, wherein each piston comprises a flow restrictor deployed therein, the flow restrictor disposed to restrict fluid flow between the piston and the hydraulic actuation module.

9. The downhole tool of claim 8, wherein each piston further comprises a pressure relief valve deployed in parallel with the flow restrictor, the pressure relief valve disposed to permit flow from the piston to the hydraulic actuation module only when a fluid pressure in the piston exceeds a predetermined value.

10. The downhole tool of claim 1, wherein each piston includes a hydraulic fluid circuit in which a flow restrictor is deployed in parallel with a check valve, the flow restrictor disposed to restrict fluid flow between the piston and the hydraulic actuation module, the check valve disposed to permit fluid flow from the hydraulic actuation module to the piston and to block reverse fluid flow.

11. The downhole tool of claim 1 being purely mechanical and not comprising any electronically or electrically controllable components.

12. A downhole tool comprising:

a downhole tool body disposed to be rotatably coupled with a drill string;

at least three blades fixed to and extending radially outward from the tool body;

at least one piston deployed in each of the blades, the pistons disposed to displace between radially opposed retracted and extended positions, the pistons able to exert sufficient outward force to overcome a centrifugal force on the tool caused by eccentric rotation of the tool in the borehole;

at least one spring member deployed in each piston, said spring member disposed to elastically spring bias the piston radially inward towards the retracted position, the spring member exerting a spring force that is greater than a centrifugal force caused by a predetermined maximum eccentric rotation of the tool in a borehole such that:

$$K_S \geq m\omega^2$$

wherein $K_S$ represents a spring constant of the spring member deployed in the piston, m represents the mass of the downhole tool, and ω represents a predetermined maximum serviceable rotation rate of the tool in units of radians per second; and a hydraulic actuation module disposed to exert a hydraulic force that extends each piston radially outward against said spring bias towards the extended position.

13. The downhole tool of claim 12, wherein an outward force exerted by each of the pistons decreases substantially linearly with increasing extension thereof.

14. The downhole tool of claim 12, wherein (i) the hydraulic force is substantially constant and (ii) the spring force increases substantially linearly with increasing extension of the pistons.

15. The downhole tool of claim 12, wherein each piston comprises a flow restrictor therein disposed to restrict fluid flow between the piston and the hydraulic actuation module.

16. The downhole tool of claim 12, wherein each piston includes a hydraulic fluid circuit in which a flow restrictor is deployed in parallel with a check valve, the flow restrictor disposed to restrict fluid flow between the piston and the hydraulic actuation module, the check valve disposed to permit fluid flow from the hydraulic actuation module to the piston and to block reverse fluid flow.

17. The downhole tool of claim 12, wherein the spring force and the hydraulic force are preselected such that they balance external forces acting on the piston during rotation of the tool in a subterranean borehole, said balance of forces causing the tool to be continually urged towards a center of the borehole during rotation of the tool in the borehole.

18. The downhole tool of claim 12, being purely mechanical and not comprising any electronically or electrically controllable components.

19. A downhole tool comprising:

a downhole tool body disposed to be rotatably coupled with a drill string;

at least three blades fixed to and extending radially outward from the tool body;

at least one piston deployed in each of the blades, the pistons disposed to displace between radially opposed retracted and extended positions;

at least one spring member deployed in each piston, said spring member disposed to elastically bias said piston radially inward towards the retracted position;

a hydraulic actuation module disposed to extend each piston radially outward against said spring bias towards the extended position; and each piston including a hydraulic fluid circuit in which a flow restrictor is deployed in parallel with a check valve, the flow restrictor disposed to restrict fluid flow from the piston to the hydraulic actuation module, the check valve disposed to permit fluid flow only from the hydraulic actuation module to the piston.

20. The downhole tool of claim 19, wherein the hydraulic fluid circuit permits rapid extension of the piston and restricts retraction of the piston.

21. The downhole tool of claim 19, wherein the hydraulic fluid circuit further comprises a pressure relief valve deployed in parallel with the flow restrictor and the check valve, the pressure relief valve disposed to permit flow from the piston to the hydraulic actuation module only when a fluid pressure in the piston exceeds a predetermined value.

22. The downhole tool of claim 19 being purely mechanical and not comprising any electronically or electrically controllable components.

23. A purely mechanical downhole stabilizer comprising:

a downhole stabilizer body disposed to be rotatably coupled with a drill string;

at least three blades fixed to and extending radially outward from the tool body;

at least one piston deployed in each of the blades, the pistons disposed to displace between radially opposed retracted and extended positions, each piston including a hydraulic fluid circuit in which a flow restrictor is deployed in parallel with a check valve, the flow restrictor disposed to restrict fluid flow from the piston to the hydraulic actuation module, the check valve disposed to permit fluid flow only from the hydraulic actuation module to the piston;

at least one spring member deployed in each piston, said spring member disposed to exert a spring force that elastically spring biases the piston radially inward towards the retracted position, the spring member exerting a spring force that is greater than a centrifugal force caused by a predetermined maximum eccentric rotation of the stabilizer in a borehole;

a hydraulic actuation module disposed to exert a hydraulic force that urges each piston radially outward against the spring force towards the extended position; and the spring force and the hydraulic force being preselected such that they balance external forces acting on the piston during rotation of the tool in a subterranean borehole, said balance of forces causing the tool to be continually urged towards a center of the borehole during rotation of the tool in the borehole.

* * * * *